US010799080B2

(12) United States Patent
Cho et al.

(10) Patent No.: US 10,799,080 B2
(45) Date of Patent: Oct. 13, 2020

(54) CLEANER

(71) Applicant: SAMSUNG ELECTRONICS CO., LTD., Suwon-si (KR)

(72) Inventors: Jeong Hee Cho, Hwaseong-si (KR); Sang Il Hyun, Suwon-si (KR); Tae Gwang Kim, Suwon-si (KR); Byung Jo Lee, Yongin-si (KR); Dong Hun Yoo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 203 days.

(21) Appl. No.: 15/655,990

(22) Filed: Jul. 21, 2017

(65) Prior Publication Data

US 2018/0020890 A1 Jan. 25, 2018

(30) Foreign Application Priority Data

Jul. 22, 2016 (KR) ..... 10-2016-0093296

(51) Int. Cl.

| | |
|---|---|
| ***A47L 5/30*** | (2006.01) |
| ***A47L 9/04*** | (2006.01) |
| ***A47L 9/24*** | (2006.01) |
| ***A47L 9/16*** | (2006.01) |
| ***A47L 9/00*** | (2006.01) |

(52) U.S. Cl.

CPC ..... *A47L 5/30* (2013.01); *A47L 9/009* (2013.01); *A47L 9/0444* (2013.01); *A47L 9/0477* (2013.01); *A47L 9/1683* (2013.01); *A47L 9/242* (2013.01); *A47L 9/246* (2013.01)

(58) Field of Classification Search

CPC ..... A47L 5/30; A47L 9/009; A47L 9/0444; A47L 9/0477; A47L 9/1683; A47L 9/242; A47L 9/246; A47L 5/28; A47L 9/1427; A47L 5/24; A47L 5/32

See application file for complete search history.

(56) References Cited

U.S. PATENT DOCUMENTS 1,971,493 A * 8/1934 Leathers ..... A47L 9/06 15/369
2,703,903 A * 3/1955 Faith-Ell ..... A47L 9/06 15/365

(Continued)

FOREIGN PATENT DOCUMENTS

JP 2000354567 A 12/2000
JP 2003512879 A 4/2003

(Continued)

*Primary Examiner* — Robert J Scruggs
(74) *Attorney, Agent, or Firm* — Staas & Halsey LLP

(57) ABSTRACT

Disclosed herein is a cleaner with improved cleaning efficiency. A cleaner includes a main body having a dust collecting unit and a suction head including a head cover, a base plate having a suction port to suck in foreign substances on a surface to be cleaned and coupled to the head cover, and a brush rotatably provided between the head cover and the base plate, wherein the base plate includes a first inclined portion slantly extending from a front end of the suction port with respect to the surface to be cleaned, and a second inclined portion slantly extending from a rear end of the suction port with respect to the surface to be cleaned, and integrally formed with the first inclined portion.

9 Claims, 10 Drawing Sheets

(56) References Cited

U.S. PATENT DOCUMENTS

| | | | | |
|---|---|---|---|---|
| 4,888,850 | A * | 12/1989 | Helmes | A47L 9/02 15/359 |
| 2003/0159225 | A1 | 8/2003 | Kuo | |
| 2010/0107358 | A1* | 5/2010 | Wibbling | A47L 9/06 15/415.1 |
| 2013/0145577 | A1* | 6/2013 | Davidshofer | A47L 5/30 15/383 |
| 2016/0037987 | A1* | 2/2016 | Caro | A47L 9/04 15/334 |

FOREIGN PATENT DOCUMENTS

| | | | |
|---|---|---|---|
| JP | 2004267723 | A | 9/2004 |
| JP | 5143974 | B1 | 2/2013 |

* cited by examiner

CLEANER

CROSS-REFERENCE TO RELATED APPLICATIONS

This application claims the benefit of Korean Patent Application No. 10-2016-0093296, filed on Jul. 22, 2016 in the Korean Intellectual Property Office, the disclosure of which is incorporated herein by reference.

BACKGROUND

1. Field

The present disclosure relates to a cleaner, and more particularly, to a cleaner having improved cleaning efficiency.

2. Description of the Related Art

A cleaner is a device that removes foreign substances in the room. Generally, vacuum cleaners are often used at home. The vacuum cleaner sucks air using a suction force of a blower and separates foreign substances from the air suctioned by a device such as a filter, and thereby cleans the room. The vacuum cleaner can be largely divided into a canister type and an upright type.

The canister type vacuum cleaner includes a main body in which a blowing device and a dust collecting device are provided inside, a suction body installed separately from the main body to suck in dust on the floor, and a connecting pipe connecting the main body and the suction body and having a handle installed therein. The user performs cleaning while holding the handle and moving the suction body in a direction to clean.

The upright type vacuum cleaner includes an upright main body, a suction body integrally coupled to a lower portion of the main body, a wheel that allows the main body to move around the floor surface, and a handle that the user grips. Therefore, the user performs cleaning while holding the handle and moving the entire main body of the upright type vacuum cleaner.

The brush of the upright cleaner may be installed in the suction body to improve cleaning efficiency. The brush floats foreign substances stuck on the surface from the surface by contacting the surface while being rotated at high speed. The floated foreign substances are suctioned into the suction port of the suction body, and then flow into a dust collecting apparatus provided in the main body.

Meanwhile, as the gap between the bottom surface of the suction body of the upright cleaner and the surface to be cleaned increases, the area of direct contact between the brush and the carpet is widened and thus the cleaning efficiency for the carpet may be enhanced. However, due to the increase in gap between the bottom surface of the suction body and the surface to be cleaned, the suction pressure of the suction body may be reduced, thereby reducing the cleaning efficiency of the floor.

SUMMARY

One aspect of the present disclosure provides a cleaner with improved cleaning efficiency.

Another aspect of the present disclosure provides a cleaner with improved user convenience because of reduced force required to move the cleaner.

In accordance with an aspect of the present disclosure, a cleaner includes a main body having a dust collecting unit and a suction head including a head cover, a base plate having a suction port to suck in foreign substances on a surface to be cleaned and coupled to the head cover, and a brush rotatably provided between the head cover and the base plate, wherein the base plate includes a first inclined portion slantly extending from a front end of the suction port with respect to the surface to be cleaned, and a second inclined portion slantly extending from a rear end of the suction port with respect to the surface to be cleaned, and integrally formed with the first inclined portion.

The first inclined portion may be inclined upward toward the rear of the base plate, and the second inclined portion may be inclined downward toward the rear of the base plate.

The base plate may include a brush mounting portion on which the brush is mounted.

The base plate may further includes a first contact portion provided at a front end of the first inclined portion and configured to be in contact with the surface to be cleaned, and a second contact portion provided at a rear end of the second inclined portion and configured to be in contact with the surface to be cleaned.

The first contact portion and the second contact portion may be disposed in parallel to the surface to be cleaned.

The base plate may further includes a third inclined portion to reduce force required to move the cleaner forward, and a fourth inclined portion to reduce force required to move the cleaner backward.

The third inclined portion may be provided at a front end of the first contact portion and is inclined downward toward the rear of the base plate, and the fourth inclined portion may be provided at a rear end of the second contact portion and is inclined upward toward the rear of the base plate.

The first inclined portion to the fourth inclined portion may be inclined at an angle of about 5° to about 30° with respect to the surface to be cleaned.

A front-to-back width of each of the first contact portion and the second contact portion may be about 10 mm or less.

A vertical distance between a front end and a rear end of the third inclined portion may be about 5 mm or more.

The first inclined portion and the second inclined portion may be formed to be curved surfaces whose center is convex upward.

The first inclined portion and the second inclined portion may be formed to be curved surfaces whose center is convex downward.

In accordance with an aspect of the present disclosure, a cleaner includes a main body, a brush rotatably disposed at a lower portion of the main body to scatter foreign substances on a surface to be cleaned and a base plate having a suction port through which the foreign substances flows in, wherein the base plate includes a brush mounting portion on which the brush is mounted, a contact portion provided to be in contact with the surface to be cleaned, and an inclined portion integrally formed with the brush mounting portion and the contact portion, and provided between the contact portion and the suction port so that the contact portion and the suction port are separated from each other in the vertical direction.

The contact portion may include a first contact portion and a second contact portion, and the first contact portion and the second contact portion may be disposed at a front end and a rear end of the suction port, respectively.

The inclined portion may include a first inclined portion and a second inclined portion, the first inclined portion may be disposed at a rear end of the first contact portion, and the second inclined portion may be disposed at a front end of the second contact portion.

The first inclined portion may be inclined upward toward the rear of the base plate, and the second inclined portion may be inclined downward toward the rear of the base plate.

The base plate may further includes a third inclined portion slantly extending from a front end of the first contact portion with respect to the surface to be cleaned, and integrally formed with the first contact portion.

The base plate may further include a fourth inclined portion slantly extending from a rear end of the second contact portion with respect to the surface to be cleaned, and integrally formed with the second contact portion.

The third inclined portion may be inclined downward toward the rear of the base plate, and the fourth inclined portion may be inclined upward toward the rear of the base plate.

In accordance with an aspect of the present disclosure, a cleaner includes a main body, a brush rotatably disposed in a lower portion of the main body, a base plate having at least a portion of the brush mounted thereon and a suction port through which foreign substances on a surface to be cleaned flow in and a nozzle having the remaining portions of the brush mounted thereon and a discharge port through which the foreign substances flowing into the suction port are discharged, wherein the base plate includes a brush mounting portion on which at least a portion of the brush is mounted, and an inclined portion that forms the suction port together with the brush mounting portion and is inclined upward with respect to the surface to be cleaned.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Hereinafter, embodiments according to the present disclosure will be described in detail with reference to the accompanying drawings.

Figure 1:
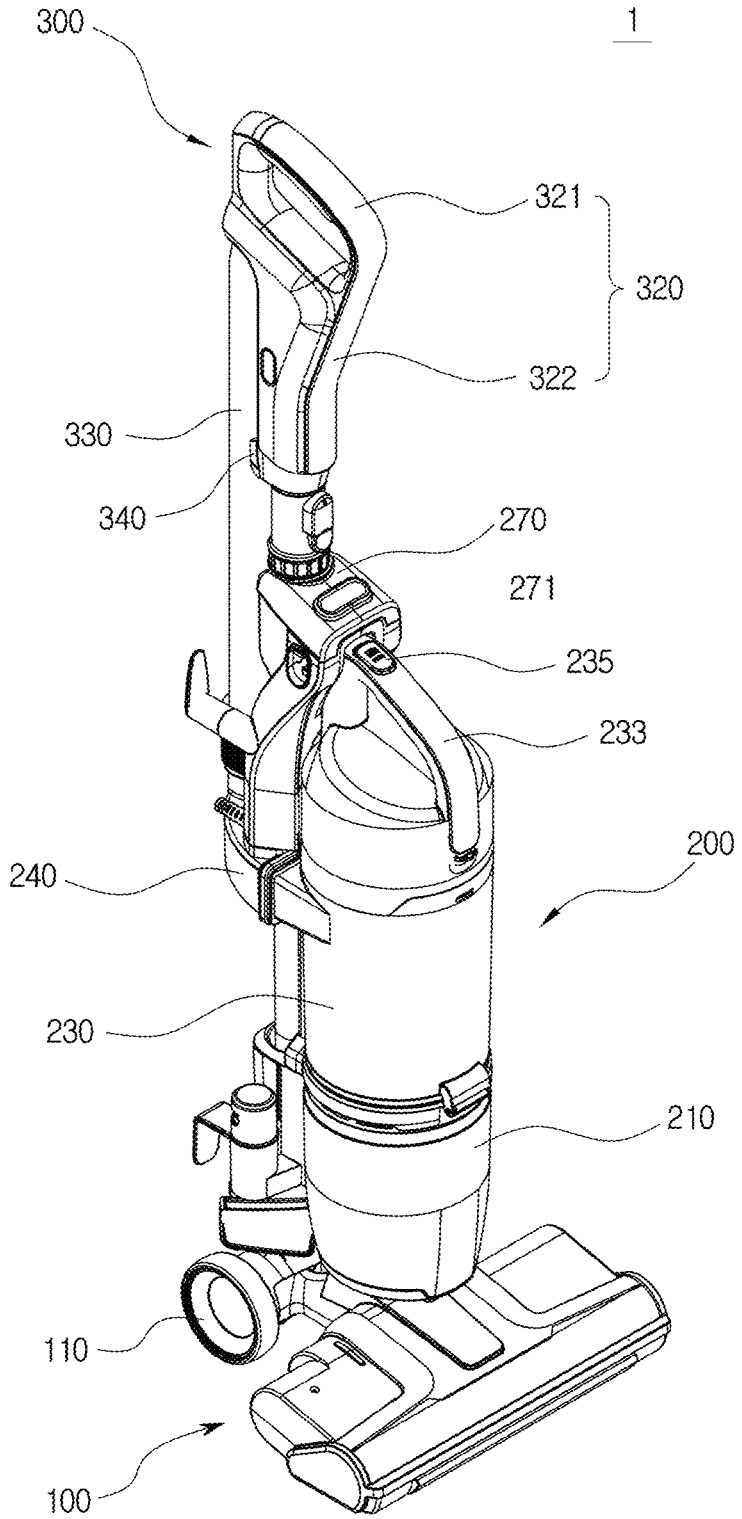
FIG. 1 is a front perspective view of a cleaner viewed according to an embodiment of the present disclosure.
Figure 2:
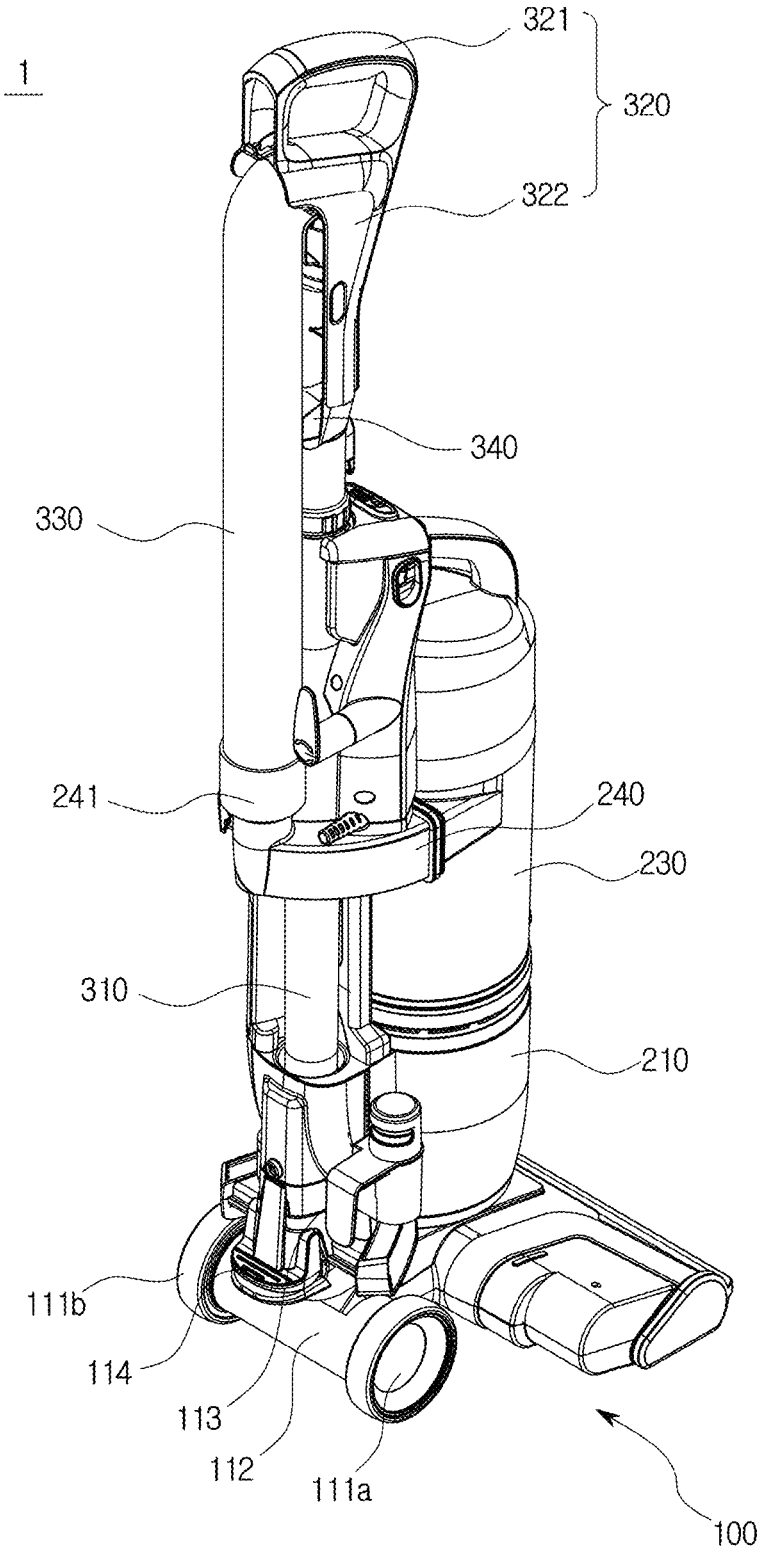
FIG. 2 is a rear right perspective view of a cleaner according to an embodiment of the present disclosure.
Figure 3:
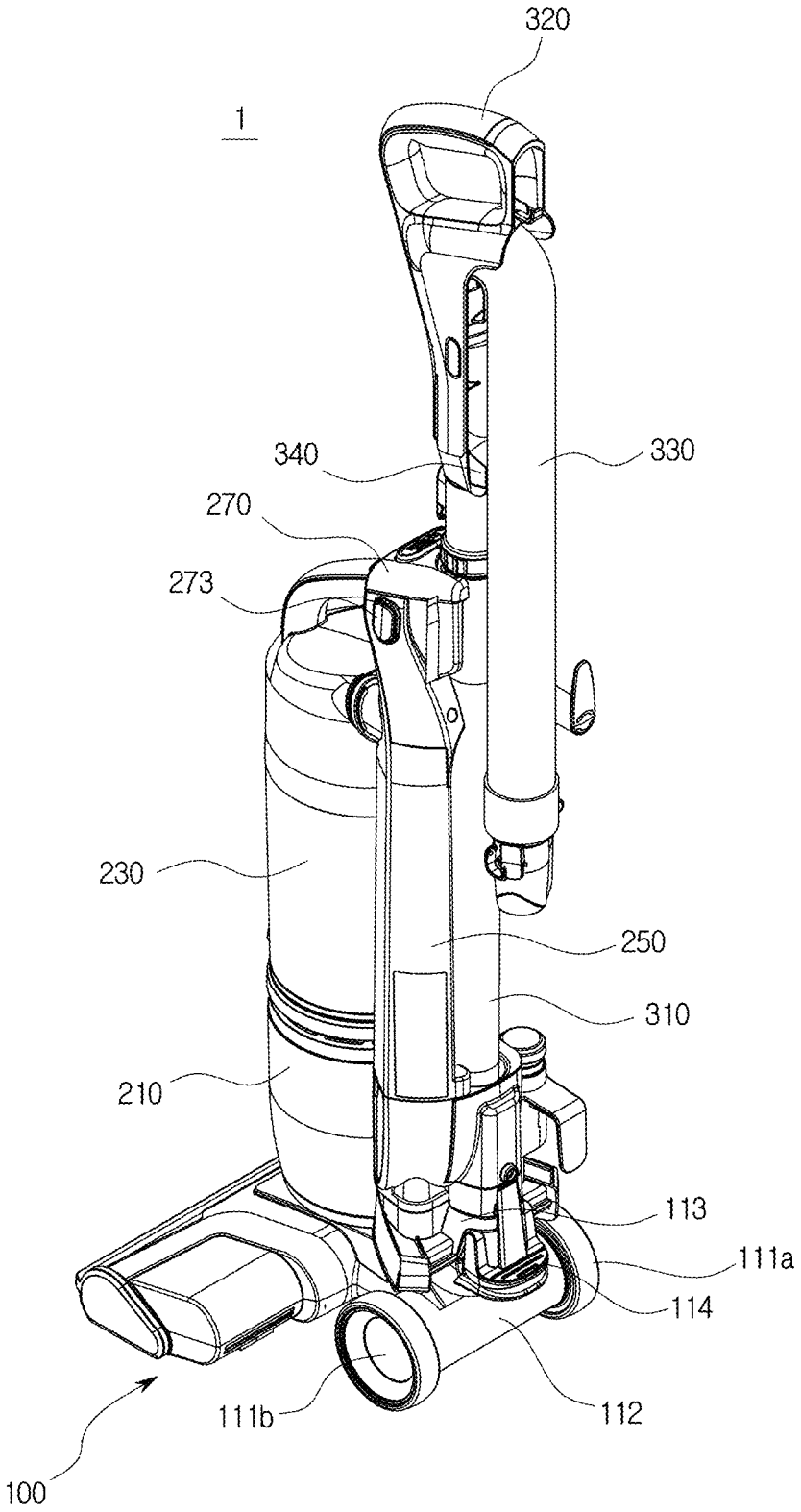
FIG. 3 is a rear left perspective view of a cleaner according to an embodiment of the present disclosure.

Referring to FIG. 1 to FIG. 3, a cleaner according to an embodiment of the present disclosure includes a first cleaning module 200 to clean the floor in an upright mode, and a second cleaning module 200 detachably mounted on the first cleaning module 200 for performing cleaning in a handy mode while being separated from the first cleaning module 200.

The first cleaning module 200 may include a main body 210, a suction head 100, and a dust collecting unit 230.

The main body 210 may be disposed on the top of the suction head 100. A fan motor (not shown) that generates suction force may be disposed inside the main body 210.

The suction head 100 may be provided to suck in dust while contacting a surface to be cleaned and being moved around the surface. The suction head 100 may include a wheel assembly 110.

The suction head 100 may be provided on a lower side of the first cleaning module 200. The suction head 100 may be provided to suck in dust that exists on the surface to be cleaned.

The wheel assembly 110 may be installed behind the suction head 100. By providing the wheel assembly 110, the suction head 100 may be able to move around the surface to be cleaned. The wheel assembly 110 will be described later.

The suction head 100 may further include a pipe connecting portion 113 and a separating lever 114.

The pipe connecting portion 113 may be connected to the connecting pipe 210 of the second cleaning module 200, which will be described later. The pipe connecting portion 113 is connected to the connecting pipe 210 so that the dust sucked in through the suction head 100 is moved into the connecting pipe 210. The pipe connecting portion 113 may be detachably coupled to the connecting pipe 210.

The separating lever 114 may be installed on one side of the pipe connecting portion 113. The separating lever 114 may separate the pipe connecting portion 113 and the connecting pipe 210 from each other. The user may separate the pipe connecting portion 113 and the connecting pipe 210 from each other by pressing the separating lever 114. The separating lever 114 may be installed at the rear of the pipe connecting portion 113 to facilitate the user's operation.

The dust collecting unit 230 may be disposed on the top of the main body 210. The dust collecting unit 230 may receive air sucked in through the suction head 100 and separate and collect dust contained in the air. In this embodiment, the dust collecting unit 230 collects dust from air in a cyclone mode. The dust collecting unit 230 may be detachable from the first cleaning module 200.

The dust collecting unit 230 may have a grip portion 233 at an upper portion thereof. A separating switch 235 may be provided on one side of an upper surface of the grip portion 233. The dust collecting unit 230 may be separated from the first cleaning module 200 by pressing the separating switch 235. The grip portion 233 may be provided to easily grasp the separated dust collecting unit 230.

The first cleaning module 200 may further include a first duct 240, a second duct 250, and a stationary frame 270.

The first duct 240 may connect the dust collecting unit 230 with a connecting hose 330 as will be described later. The first duct 240 may serve as a passage to transfer air including dust, which moves through the connecting hose 330, to the dust collecting unit 230. The first duct 240 may serve as a passage through which the suction force generated by the fan motor and transferred to the dust collecting unit 130 is transferred to the connecting hose 330.

The first duct 240 may extend rearward from one side of the dust collecting unit 230. The first duct 240 may extend in a shape that surrounds a part of the connecting pipe 310 disposed at the rear of the dust collecting unit 230. The first duct 240 may be provided in a direction perpendicular to the connecting pipe 310.

The first duct 240 may have a hose coupling portion 241 coupled with the connecting hose 330. The hose coupling portion 241 may be disposed so that the coupled connecting hose 330 extends parallel to the connecting pipe 310.

The second duct 250 may connect the main body 210 and the dust collecting unit 230. The second duct 250 may serve as a passage to transfer the suction force generated in the main body 210 to the dust collecting unit 230.

The second duct 250 may be installed at a position symmetrical to the first duct 240 with respect to the connecting pipe 310. The second duct 250 may be provided in a shape that extends in the vertical direction in parallel with the connecting pipe 310.

The stationary frame 270 may be provided to fix the position of the second cleaning module 300 in a state where the first cleaning module 200 and the second cleaning module 300 are coupled. The stationary frame 270 may be formed to extend upward from upper surfaces of the first duct 240 and the second duct 250. One side of the upper portion of the stationary frame 270 may be bent to guide the position of the connecting pipe 310.

The stationary frame 270 may include a plurality of switches 271 and 273 to drive the cleaner on one side thereof.

The connecting pipe 310 may connect the first cleaning module 200 and the second cleaning module 300.

The connecting pipe 310 may serve as a passage to transfer air containing dust suctioned in the first cleaning module 200 to the dust collecting unit 230 through the second cleaning module 300. Also, the connecting pipe 310 may serve as a passage to transfer the suction force generated by the fan motor to the suction head 100.

The handle member 320 may be coupled to one side of the connecting pipe 310. The handle member 320 may include a handle portion 321 and a handle body 322.

The handle portion 321 may be formed on the upper portion of the handle body 322. The handle portion 321 may have a shape that is capable of being grasped by the user on the upper portion of the handle body 322.

The handle body 322 may be provided with an inner space on the inner side and a rear side of the handle body 332 may be opened. The inner space may be provided as a space into which a portion of the connecting hose 330 is inserted.

The connecting hose 330 may be provided to be changed in length and shape. The connecting hose 330 may be formed with a bellows pipe whose length may be expanded and contracted within a certain range.

The connecting hose 330 may serve as a passage to transfer air including dust transferred from the connecting pipe 310 to the dust collecting unit 230 through the first duct 240. The connecting hose 330 may serve as a passage to transfer the suction force generated by the fan motor to the connecting pipe 310.

Figure 4:
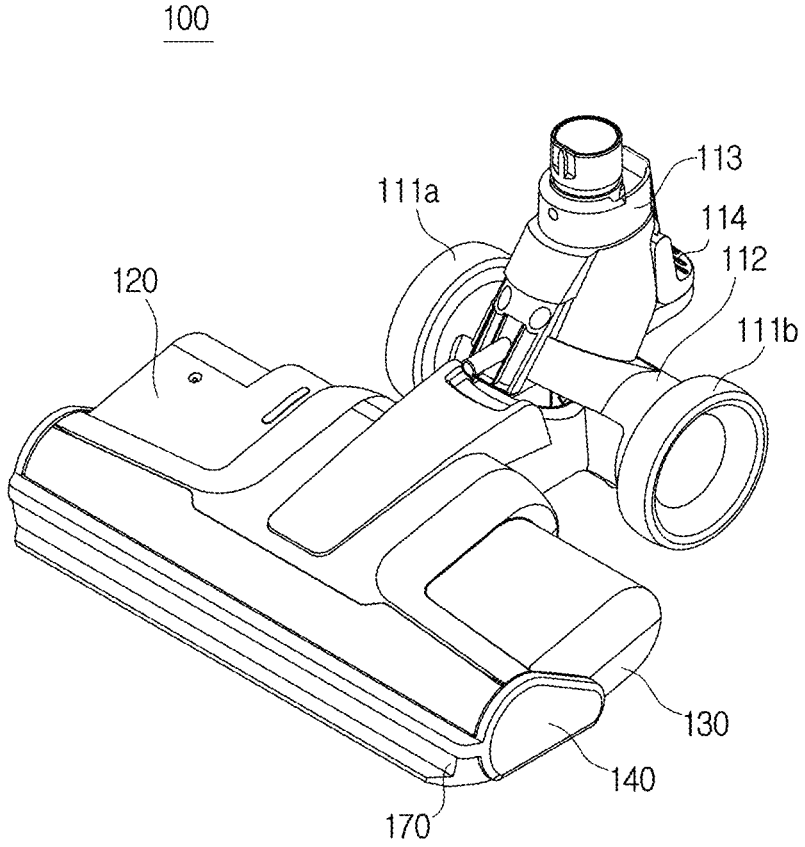
FIG. 4 is a perspective view of a suction head of a cleaner according to an embodiment of the present disclosure.
Figure 5:
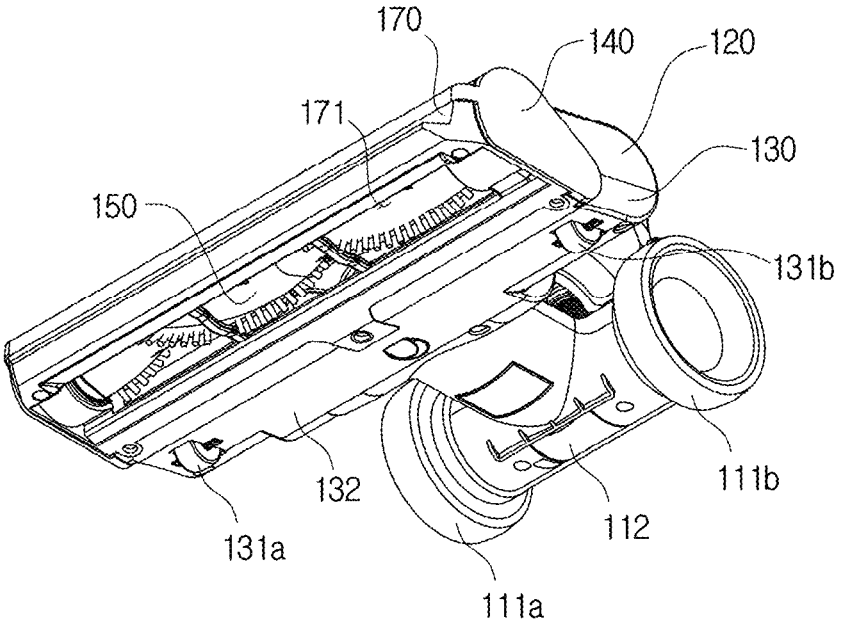
FIG. 5 is a bottom perspective view of a suction head of a cleaner according to an embodiment of the present disclosure.

Referring to FIG. 4 and FIG. 5, the suction head 100 may be configured to move across the surface to be cleaned and contact the surface to suck in foreign substances on the surface.

The suction head 100 may include a suction port 171 on the bottom through which foreign substances are sucked in. The suction port 171 may be provided as a space in which dust or foreign matters are sucked in together with air by receiving the suction force generated in the fan motor.

The suction head 100 may further include a brush 110 rotatably installed above the suction port 171. The brush 150 may rotate above the suction port 171 and float the dust adhered to the surface to be cleaned. The floated dust may be easily sucked into the cleaner 1 through the suction port 171.

The wheel assembly 110 may be installed behind the suction head 100. The wheel assembly 110 may include a pair of wheels 111*a* and 111*b* disposed on both sides and a wheel body 112 having two wheels 111*a* and 111*b* rotatably installed thereon.

The pair of wheels 111*a* and 111*b* may be provided to be in contact with the surface to be cleaned. As the pair of wheels 111*a* and 111*b* rotate, the suction head 100 and the cleaner 1 including the suction head 100 may be able to move across the surface to be cleaned.

The suction head 100 may further include a pair of wheels 131*a* and 131*b* on its bottom surface. Specifically, a lower cover 130 of the suction head 100 may be provided with the pair of wheels 131*a* and 131*b*. The wheels 131*a* and 131*b* provided on the lower cover 130 may be provided separately from the wheel assembly 110. The wheels 131*a* and 131*b* may be provided to move the suction head 100 by assisting the wheels 111*a* and 111*b* of the wheel assembly 110. Since the wheel assembly 110 is provided at the rear of the suction head 100, a base plate 170 and the front of the suction head 100 provided with the lower cover 130, on which the wheels are not provided, may still have a large frictional force with the surface to be cleaned. Therefore, the wheels 131*a* and 131*b* provided on the lower cover 130 may reduce the frictional force between the front of the suction head 100 and the surface to be cleaned, allowing the user to move the cleaner 1 with a little force. However, if the distance between the suction head 100 and the surface to be cleaned becomes large due to the wheels 131*a* and 131*b*, the suction force of the suction head 100 may be reduced. In other words, since the suction head 100 is not in close contact with the surface to be cleaned, the suction pressure of the suction head 100 may be lowered. To prevent this, the wheels 131*a* and 131*b* provided on the lower cover 130 may be formed to be smaller than the wheels 111*a* and 111*b* of the wheel assembly 110. Further, the rear of the upper cover 120 may be inclined upward, and the wheels 131*a* and 131*b* may be disposed on the inclined surface. Accordingly, even with the wheels 131*a* and 131*b*, the gap between the suction head 100 and the surface to be cleaned is maintained.

Figure 6:
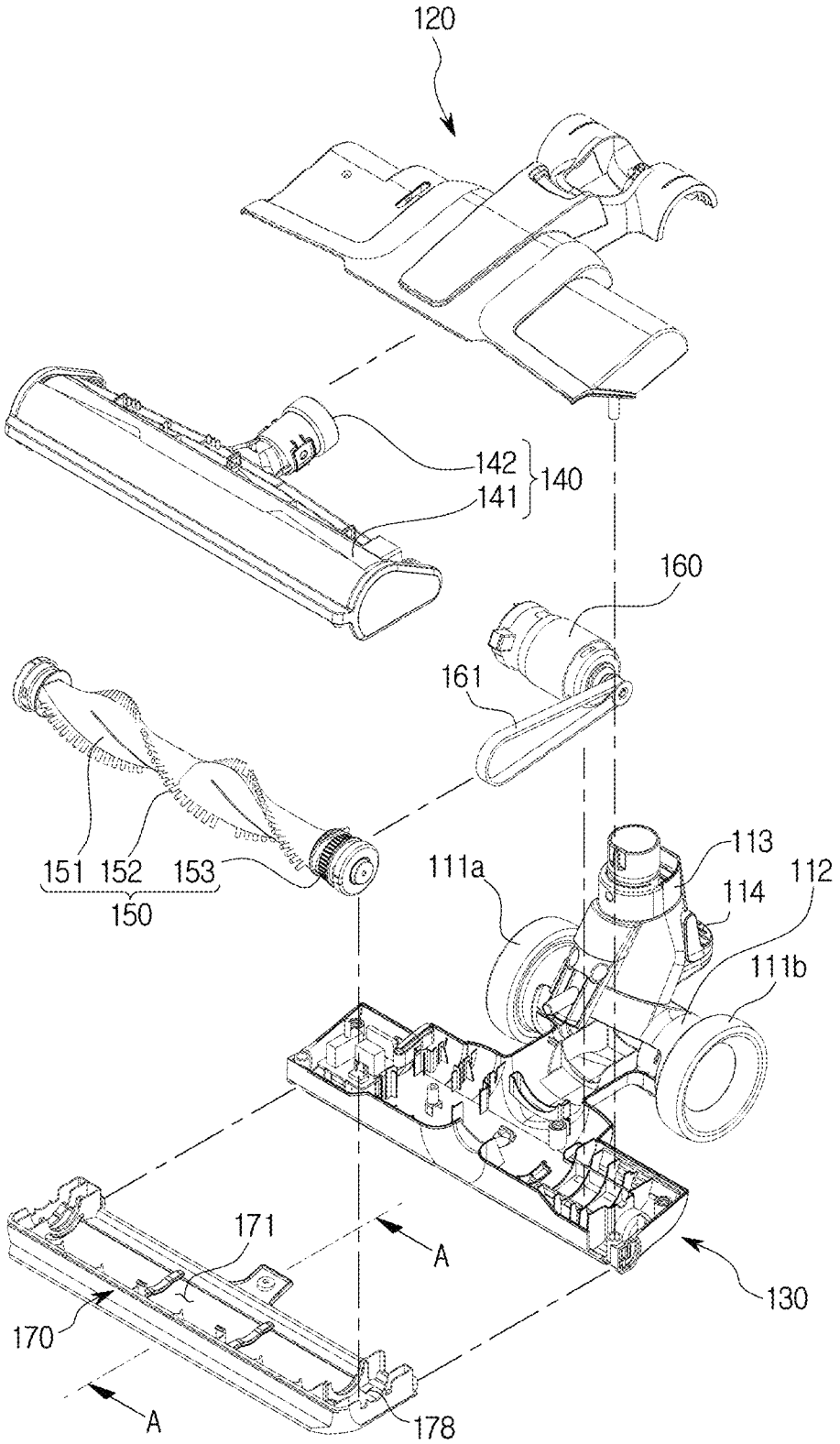
FIG. 6 is an exploded perspective view of a suction head of a cleaner according to an embodiment of the present disclosure.

FIG. 6 is an exploded perspective view of a suction head of a cleaner according to an embodiment of the present disclosure.

As shown in FIG. 6, the suction head 100 may include a wheel assembly 110, a head cover, a brush 150, a drive motor 160, and a base plate 170.

The head cover may include an upper cover 120, a lower cover 130, and a nozzle 140.

The upper cover 120 may form an upper surface of the suction head 100. The upper cover 120 is combined with the lower cover 130 to form the exterior of the suction head 100.

The lower cover 130 may include a pair of wheels 131*a* and 131*b* on its lower surface. As described above, the lower cover 130 may include an upwardly inclined surface 132 with respect to the surface to be cleaned. The inclined surface 132 may be provided behind the lower cover 130. Also, the pair of wheels 131*a* and 131*b* may be provided on the inclined surface 132.

The nozzle 140 may include a case drum 141 and a discharge port 142.

The case drum 141 may be provided to receive the upper portion of the brush 150. A portion of the brush 150 may be mounted on both sides of the case drum 141 and the remaining portion of the brush 150 may be mounted on the base plate 170, which will be described later.

A suction pressure may be formed inside the case drum 141. Specifically, the suction pressure generated by the fan motor may be formed inside the case drum 141. The foreign substances on the surface to be cleaned flow into the discharge port 142 through the case drum 141 by the suction pressure.

The discharge port 142 may be provided at the rear of the case drum 141. Foreign substances on the surface to be cleaned, which have flowed into the suction port 171, may be moved into the dust collecting unit 230 through the case drum 141 and the discharge port 142.

The brush 150 may include a disturbing device 151, bristles 152 provided on the surface of the disturbing device 151, and a belt connecting portion 153.

The disturbing device 151 may be provided in a substantially cylindrical shape. The disturbing device 151 may include a streamlined protrusion on the surface to effectively scatter or sweep foreign substances on the surface to be cleaned.

The bristles 152 may be provided on the surface of the disturbing device 151. The bristles 152 may scatter or sweep foreign substances by making direct contact with the surface to be cleaned. The bristles 152 may be provided on the protrusion of the disturbing device 151.

The belt connecting portion 153 may be provided on one side of the disturbing device 151. The belt connecting portion 153 may connect a belt 161, which will be described later, and the disturbing device 151. In an embodiment of the present disclosure, the belt connecting portion may be provided with a gear having sawteeth.

The suction head 100 may include a driving motor 160 to apply rotational force to the brush 150 and the belt 161 for transferring the rotational force from the driving motor 160 to the brush 150.

The driving motor 160 may provide the rotational force. The driving motor 160 may be mounted on one side of the lower cover 130.

A belt 161 may be connected to the rotating shaft of the driving motor 160. The belt 161 may be connected to the belt connecting portion 153 provided at one side of the disturbing device 151. Therefore, one side of the belt 161 is connected to the rotating shaft of the driving motor 160, and the other side is connected to the belt connecting portion 153. Accordingly, the rotational force of the driving motor 160 may be transfered to the brush 150 using the belt 161.

The suction head 100 may include the base plate 170 having the suction port 171.

The base plate 170 may be disposed below the suction head 100. The base plate 170 may be coupled to the lower cover 130 to form a lower surface of the suction head 100.

The base plate 170 may include a brush mounting portion 178. The brush 150 may be mounted on the brush mounting portion 178. Both ends of the disturbing device 151 may be mounted on the brush mounting portion 178. Further, a lower portion of the disturbing device 151 may be mounted on the brush mounting portion 178. The upper portion of the disturbing device 151 may be mounted on the case drum 141 of the nozzle 140. Specifically, the brush 150 may be disposed in a space between the case drum 141 and the base plate 170.

Figure 7:
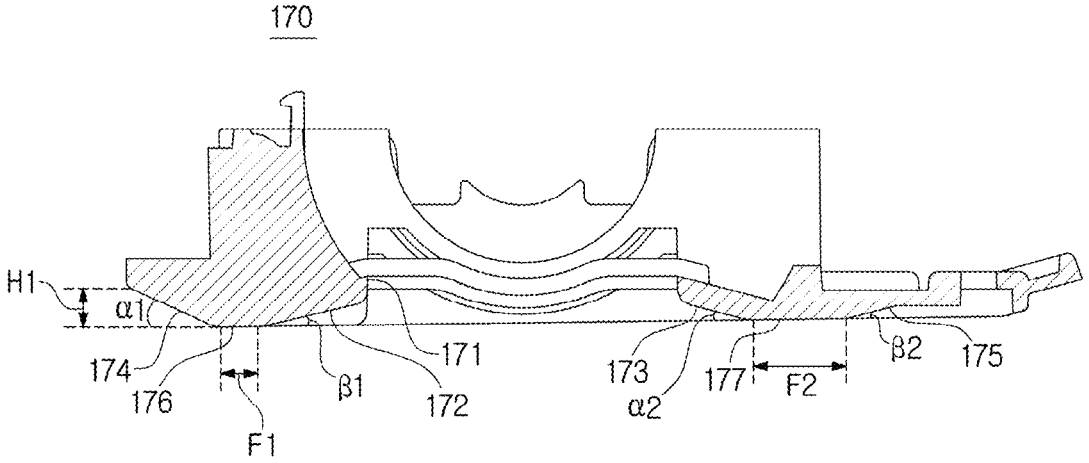
FIG. 7 is a side cross-sectional view of a base plate cut along line A-A in FIG. 6.

FIG. 7 is a side cross-sectional view of a base plate cut along the line A-A in FIG. 6.

In the following, the front of the base plate 170 may refer to the left side of FIG. 7, and the rear of the base plate 170 may refer to the right side of FIG. 7.

The base plate 170 may include a first inclined portion 172 and a second inclined portion 173, which are provided in front of and behind the suction port 171, respectively.

The first inclined portion 172 is provided at the front end 171*a* of the suction port 171. The first inclined portion 172 is inclined upward with respect to the surface to be cleaned. That is, the first inclined portion 172 may be inclined upward from the front to the rear.

The second inclined portion 173 may be provided at the rear end 171*b* of the suction port 171. The second inclined portion 173 may be inclined downward with respect to the surface to be cleaned. That is, the second inclined portion 173 may be inclined downward from the front toward the rear.

The first inclined portion 172 and the second inclined portion 173 may form the suction port 171. The first inclined portion 172 and the second inclined portion 173 may be apart from each other to form the suction port 171. In other words, the suction port 171 may be formed between the first inclined portion 172 and the second inclined portion 173.

As the first inclined portion 172 and the second inclined portion 173 are inclined in opposite directions, the suction port 171 may be placed a certain distance upward from the surface to be cleaned. A predetermined space may be formed below the first inclined portion 172 and the second inclined portion 173. A first contact portion 176 may be provided at one end of the first inclined portion 172. A second contact portion 177 may be provided at one end of the second inclined portion 173. The first contact portion 176 and the second contact portion 177 may be provided in parallel with the surface to be cleaned. When the first contact portion 176 and the second contact portion 177 come into contact with the surface to be cleaned, a gap between the first inclined portion 172 and the second inclined portion 173 and the surface to be cleaned forms a space. Accordingly, the cleaning efficiency of the cleaner according to the embodiment of the present disclosure may be improved. A detailed description thereof will be described later.

The first inclined portion 172 and the second inclined portion 173 may be inclined at about 5° to about 30° with respect to the surface to be cleaned. The inclination angles of the first inclined portion 172 and the second inclined portion 173 may be different from each other. Also, the lengths of the first inclined portion 172 and the second inclined portion 173 may be different from each other.

The base plate may further include the first contact portion 176 and the second contact portion 177.

The first contact portion 176 may be provided at a front end of the first inclined portion 172. The first contact portion 176 may be provided to be in contact with the surface to be cleaned. The first contact portion 176 may be disposed in parallel with the surface to be cleaned. The first contact portion 176 may be formed flat and may be placed horizontally to the surface to be cleaned.

The second contact portion 177 may be provided at a rear end of the second inclined portion 173. The second contact portion 177 may be provided to be in contact with the surface to be cleaned like the first contact portion 176. The second abutting portion 177 may be disposed in parallel with the surface to be cleaned, and may be formed flat.

Contacting of the first and second contact portions 176 and 177 with the surface to be cleaned may improve the suction force of the cleaner 1. Specifically, when the first contact portion 176 and the second contact portion 177 contact the surface to be cleaned, tightness between the base plate 170 and the surface to be cleaned may increase due to the suction force of the fan motor. The increased tightness between the base plate 170 and the surface to be cleaned may block the inflow of external air to the lower portion of the base plate 170. When the inflow of outside air is blocked, the suction force of the fan motor acts only on the cleaning area below the suction port 171. Specifically, since the suction force of the fan motor does not suck in the air outside the base plate 170 but reaches only the cleaning area around the suction port 171, the loss of the fan motor suction force may be reduced. In addition, cleaning efficiency of the cleaner may be improved.

The first contact portion 176 and the second contact portion 177 may define the area of the surface to be cleaned that may be cleaned by the suction force of the suction head 100. Without the first contact 176 and the second contact 177, as described above, the suction force of the suction head 100 may not be concentrated and thus the cleaning efficiency of the cleaner 1 may be reduced.

A front-to-rear length F1 of the first contact portion 176 may be about 10 mm or less. The front-to-rear length of the first contact portion 176 may be referred to as the width of the first contact portion 176. That is, the width F1 of the first contact portion 176 may be set to about 10 mm or less. If the width F1 of the first contact portion 176 is too large, the pressure applied to the nozzle 140 of the suction head 100 increases, and more force may be required to move the cleaner 1. If the force required to move the cleaner 1 increases, labor intensity of the user becomes higher in using the cleaner 1, and the user convenience may be reduced. Therefore, it is preferable that the width F1 of the first contact portion 176 is set to about 10 mm or less. However, the present disclosure is not limited thereto, and the size of the width may vary depending on the sizes of the cleaner and the suction head.

A width F2 of the second contact portion 177 may be set to about 10 mm or less like the first contact portion 176. The description of the width F2 of the second contact portion 177 will be omitted because it overlaps what is described above about the width F1 of the first contact portion 176.

The base plate may further include a third inclined portion 174 and a fourth inclined portion 175.

The third inclined portion 174 is provided at the front end of the first contact portion 176. The third inclined portion 174 is inclined in an opposite direction to the first inclined portion 172. The third inclined portion 174 is inclined downward from the front of the base plate 170 toward the rear of the base plate 170. The third inclined portion 174 has a first contact portion 176 at one end thereof. One end of the third inclined portion 174 or the first contact portion 176 may be inclined upward to the other end of the third inclined portion 174.

The third inclined portion 174 may reduce the force required to move the cleaner 1 in moving the cleaner 1 forward. The third inclined portion 174 is provided on the front portion of the base plate 170. By providing the third inclined portion 174, the foreign substances on the surface to be cleaned is guided by the first contact portion 176. Specifically, the third inclined portion 174 guides the foreign substances that hinders moving of the suction head 100 to the gap between the first contact portion 176 and the surface to be cleaned. The foreign substances are put into the suction port 171 through the first contact portion 176. The third inclined portion 174 allows the foreign substances in front of the suction head 100 to flow into the suction port 171, thereby reducing the force required to move the cleaner 1 in moving the cleaner 1 forward.

Like the third inclined portion 174, the fourth inclined portion 175 may reduce the force required to move the cleaner 1. The fourth inclined portion 175 may reduce the force required to move the cleaner 1 in moving the cleaner 1 backward. A description overlapping with the above description will be omitted.

A height H1 of the third inclined portion 174 may be about 5 mm or more. The height H1 of the third inclined portion 174 may refer to a vertical distance between one end of the third inclined portion 174 and the other end of the third inclined portion 174. In other words, the height H1 of the third inclined portion 174 refers to a vertical distance between the first contact portion 176 and the end of the third inclined portion 174. If the height H1 of the third inclined portion 174 is set to about 5 mm or more, the suction head 100 cleans the surface to be cleaned without pushing out fallen grains of rice, sand, cereal, or the like, which are often present on the surface to be cleaned. Therefore, it may save the trouble of cleaning again relatively large-sized foreign substances, such as grains of rice, sand, cereal, etc., which have been pushed out by the suction head 100. The height H1 of the third inclined portion 174 is preferably about 5 mm or more for the above reason. For the same reason, the inclination angle $\alpha 1$ of the third inclined portion 174 with respect to the surface to be cleaned is preferably about 20 to about 30 degrees.

The fourth inclined portion 175 may be inclined at about 5° to about 30° with respect to the surface to be cleaned. The inclination angles of the second inclined portion 173 and the fourth inclined portion 175 may be different from each other. Also, the first inclined portion 172 and the second inclined portion 173 may have different lengths.

According to an embodiment of the present disclosure, the inclination angle $\alpha 1$ of the third inclined portion 174 with respect to the surface to be cleaned and the inclination angle $\alpha 2$ of the second inclined portion 173 with respect to the surface to be cleaned may be the same. The inclined angle $\beta 1$ of the first inclined portion 172 with respect to the surface to be cleaned and the inclined angle of the fourth inclined portion $\beta 2$ with respect to the surface to be cleaned may be the same.

Figure 8:
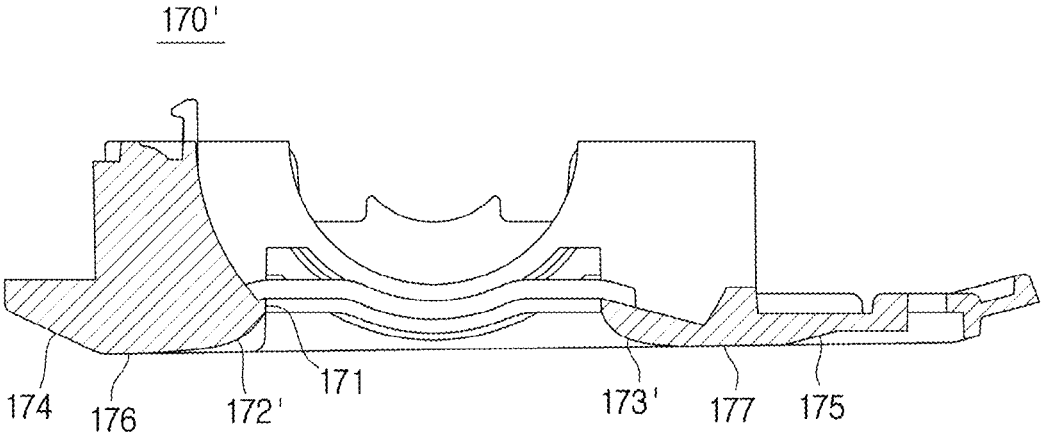
FIG. 8 is a side cross-sectional view of a base plate of a cleaner according to another embodiment of the present disclosure.
Figure 9:
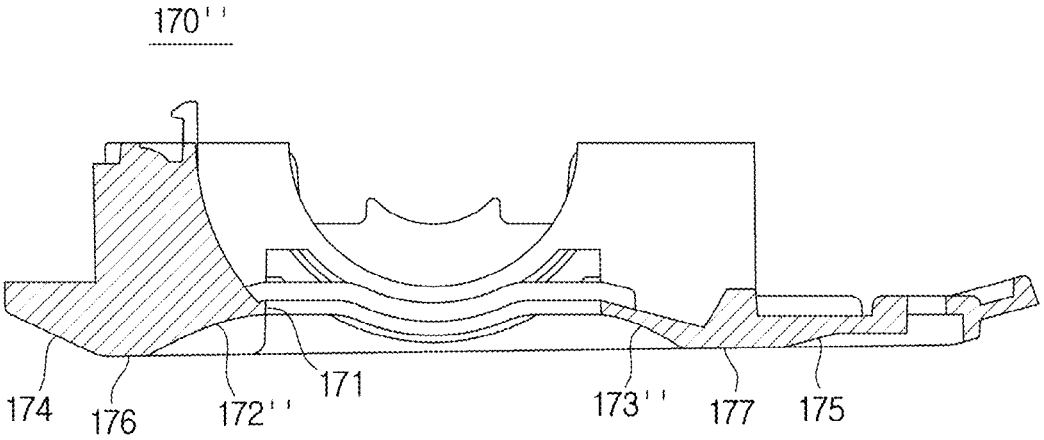
FIG. 9 is a side cross-sectional view of a base plate of a cleaner according to another embodiment of the present disclosure.

FIG. 8 is a side cross-sectional view of a base plate of the cleaner according to another embodiment of the present disclosure and FIG. 9 is a side cross-sectional view of a base plate of the cleaner according to another embodiment of the present disclosure.

Referring to FIG. 8 and FIG. 9, the first inclined portion and the second inclined portion may be formed as curved surfaces.

As shown in FIG. 8, the first inclined portion 172' and the second inclined portion 173' may have curved surfaces whose centers are convex downward. As shown in FIG. 9, the first inclined portion 172" and the second inclined portion 173" may have curved surfaces whose centers are convex upward. That is, in the cleaner according to the present disclosure, the first inclined portion and the second inclined portion may be formed to be flat planes, without being limited thereto, and may be formed to be curved surfaces as shown in FIG. 8 and FIG. 9. However, FIG. 8 and FIG. 9 are merely examples, and the first inclined portion and the second inclined portion may be formed as differently curved surfaces, which are not shown in the drawings.

Figure 10:
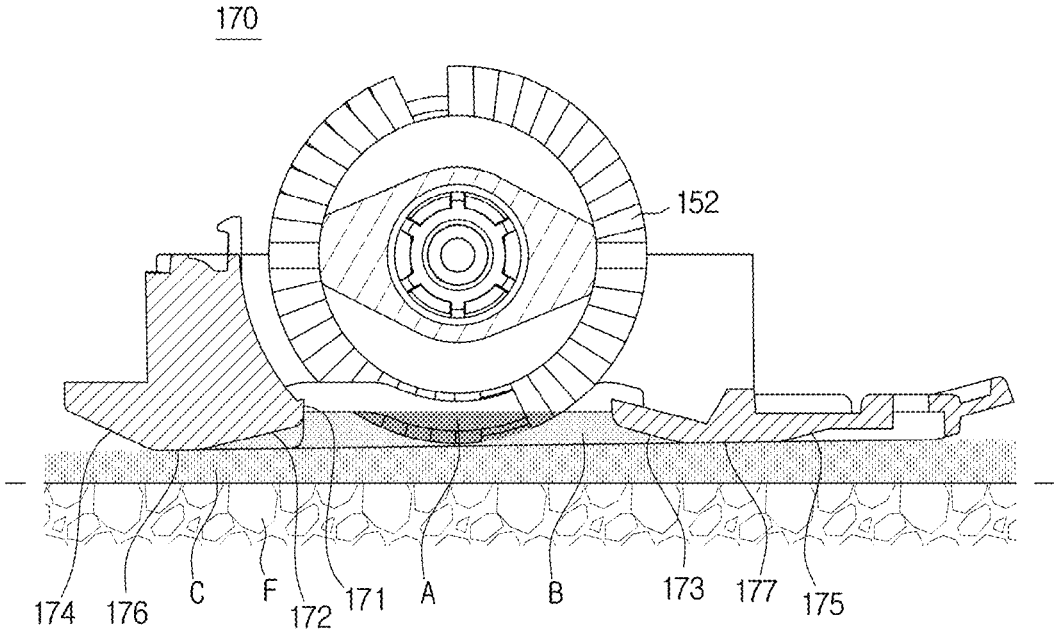
FIG. 10 is a view of a cleaning area of a cleaner according to an embodiment of the present disclosure.

FIG. 10 shows a cleaning area of a suction head of a cleaner according to an embodiment of the present disclosure.

As shown in FIG. 10, the surface to be cleaned may include a floor F and a carpet C placed on the floor F. Hereinafter, the cleaning area and the cleaning efficiency for the carpet C of the suction head 100 will be described in detail.

The carpet cleaning area of the suction head 100 may include an active cleaning area A and a passive cleaning area B. Specifically, the active cleaning area A may refer to an area where the bristles 152 of the brush 150 directly contacts the hair of the carpet C to sweep or scatter the foreign substances on the carpet C. The passive cleaning area B may refer to an area where the bristles 152 of the brush 150 does not directly touch but comes under suction pressure due to the suction force of the fan motor. The active cleaning area A is an area that the suction force of the fan motor affects in addition to the direct rotational force by the brush 150. The passive cleaning area B is an area that the suction force of the fan motor affects.

According to the idea of the present disclosure, both the active cleaning area A and the passive cleaning area B of the suction head 100 may be expanded.

An area below the first inclined portion 172 and the second inclined portion 173 is expanded into the passive cleaning area B because of the presence of the first and second inclined portions 172 and 173, as compared with the case where only the flat surface such as the first contact portion 176 and the second contact portion 177 is present. The passive cleaning area B may be expanded by the area formed between the first and second inclined portions 172 and 173 and the carpet C.

The first inclined portion 172 and the second inclined portion 173 are provided so that the suction port 171 is disposed higher than the first and second contact portions 176 and 177. The suction port 171 is located above the surface to be cleaned, so that the hair of the carpet C may be oriented upward toward the suction port 171. The hair of the carpet C in the cleaning areas A and B may be directed upward to be in contact with the brush 150. This may expand the active cleaning area A in which the hair of the carpet C and the bristles 152 of the brush 150 are in direct contact.

Therefore, in the cleaner 1 according to the present disclosure, both the active cleaning area A and the passive cleaning area B may be expanded, thereby improving carpet cleaning efficiency.

According to the present disclosure, it is possible to provide a cleaner with improved cleaning efficiency.

According to the present disclosure, it is possible to provide a cleaner to improve user convenience by reducing the force required to move the cleaner.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A cleaner comprising:

a main body having a dust collecting unit; and a suction head including a head cover, a base plate having a suction port to suck in foreign substances on a surface to be cleaned and coupled to the head cover, and a brush rotatably provided between the head cover and the base plate, wherein the base plate includes:

a first inclined portion slantly extending from a front end of the suction port with respect to the surface to be cleaned, a second inclined portion slantly extending from a rear end of the suction port with respect to the surface to be cleaned, and integrally formed with the first inclined portion, a first contact portion provided at a front end of the first inclined portion and configured to be in contact with the surface to be cleaned, a second contact portion provided at a rear end of the second inclined portion and configured to be in contact with the surface to be cleaned, a third inclined portion provided at a front end of the first contact portion and is inclined downward toward the rear of the base plate, and a fourth inclined portion provided at a rear end of the second contact portion and is inclined upward toward the rear of the base plate, the third inclined portion and the fourth inclined portion are inclined at an angle of 5° to 30° with respect to the surface to be cleaned, wherein an inclination angle of the third inclined portion with respect to the surface to be cleaned is greater than an inclination angle of the first inclined portion with respect to the surface to be cleaned, an inclination angle of the fourth inclined portion with respect to the surface to be cleaned is greater than an inclination angle of the second inclined portion with respect to the surface to be cleaned, and wherein the first inclined portion and the second inclined portion are formed to be curved surfaces having a center that is convex upward.

2. The cleaner according to claim 1, wherein the first inclined portion is inclined upward toward the rear of the base plate, and the second inclined portion is inclined downward toward the rear of the base plate.

3. The cleaner according to claim 1, wherein the base plate includes a brush mounting portion on which the brush is mounted.

4. The cleaner according to claim 1, wherein the first contact portion and the second contact portion are disposed in parallel to the surface to be cleaned.

5. The cleaner according to claim 1, wherein the first inclined portion and the second inclined portion are inclined at an angle of 5° to 30° with respect to the surface to be cleaned.

6. The cleaner according to claim 1, wherein a front-to-back width of each of the first contact portion and the second contact portion is about 10 mm or less.

7. The cleaner according to claim 1, wherein a vertical distance between a front end and a rear end of the third inclined portion is about 5 mm or more.

8. A cleaner comprising:

a main body;

a brush rotatably disposed at a lower portion of the main body to scatter foreign substances on a surface to be cleaned; and a base plate having a suction port through which the foreign substances flows in, wherein the base plate comprises:

a brush mounting portion on which the brush is mounted, a first inclined portion slantly extending from a front end of the suction port with respect to the surface to be cleaned, a second inclined portion slantly extending from a rear end of the suction port with respect to the surface to be cleaned, and integrally formed with the first inclined portion, a first contact portion provided at a front end of the first inclined portion and configured to be in contact with the surface to be cleaned, a second contact portion provided at a rear end of the second inclined portion and configured to be in contact with the surface to be cleaned, a third inclined portion provided at a front end of the first contact portion and is inclined downward toward the rear of the base plate, a fourth inclined portion provided at a rear end of the second contact portion and is inclined upward toward the rear of the base plate, the third inclined portion and the fourth inclined portion are inclined at an angle of 5° to 30° with respect to the surface to be cleaned, and wherein an inclination angle of the third inclined portion with respect to the surface to be cleaned is greater than an inclination angle of the first inclined portion with respect to the surface to be cleaned, an inclination angle of the fourth inclined portion with respect to the surface to be cleaned is greater than an inclination angle of the second inclined portion with respect to the surface to be cleaned, and wherein the first inclined portion and the second inclined portion are formed to be curved surfaces that are convex upward.

9. A cleaner comprising:

a main body;

a brush rotatably disposed in a lower portion of the main body;

a base plate having at least a portion of the brush mounted thereon and a suction port through which foreign substances on a surface to be cleaned flow in; and a nozzle having the remaining portions of the brush mounted thereon and a discharge port through which the foreign substances flowing into the suction port are discharged, wherein the base plate comprises:

a brush mounting portion on which at least a portion of the brush is mounted, a first inclined portion slantly extending from a front end of the suction port with respect to the surface to be cleaned, and a second inclined portion slantly extending from a rear end of the suction port with respect to the surface to be cleaned, and integrally formed with the first inclined portion, a first contact portion provided at a front end of the first inclined portion and configured to be in contact with the surface to be cleaned, a second contact portion provided at a rear end of the second inclined portion and configured to be in contact with the surface to be cleaned, a third inclined portion provided at a front end of the first contact portion and is inclined downward toward the rear of the base plate, a fourth inclined portion provided at a rear end of the second contact portion and is inclined upward toward the rear of the base plate, the third inclined portion and the fourth inclined portion are inclined at an angle of 5° to 30° with respect to the surface to be cleaned, and wherein an inclination angle of the third inclined portion with respect to the surface to be cleaned is greater than an inclination angle of the first inclined portion with respect to the surface to be cleaned, an inclination angle of the fourth inclined portion with respect to the surface to be cleaned is greater than an inclination angle of the second inclined portion with respect to the surface to be cleaned, and wherein the first inclined portion and the second inclined portion are formed to be curved surfaces that are convex upward.

* * * * *